US009746171B2

(12) United States Patent
Marinus et al.

(10) Patent No.: US 9,746,171 B2
(45) **Date of Patent: *Aug. 29, 2017**

(54) ILLUMINATION DEVICE

(71) Applicant: PHILIPS LIGHTING HOLDING B.V., Eindhoven (NL)

(72) Inventors: Antonius Adrianus Maria Marinus, Eindhoven (NL); Omke Jan Teerling, 't Harde (NL); Bastiaan Uitbeijerse, Helmond (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 12 days.

This patent is subject to a terminal disclaimer.

(21) Appl. No.: 14/835,045

(22) Filed: Aug. 25, 2015

(65) Prior Publication Data

US 2015/0362170 A1 Dec. 17, 2015

Related U.S. Application Data

(63) Continuation of application No. 13/321,848, filed as application No. PCT/IB2010/052282 on May 21, 2010, now Pat. No. 9,360,203.

(30) Foreign Application Priority Data

| | | |
|---|---|---|
| May 28, 2009 | (EP) | 09161346 |
| Jul. 22, 2009 | (EP) | 09166081 |
| May 6, 2010 | (EP) | 10162146 |

(51) Int. Cl.
*F21V 3/00* (2015.01)
*F21V 5/00* (2015.01)
(Continued)

(52) U.S. Cl.
CPC ..... *F21V 29/86* (2015.01); *F21K 9/23* (2016.08); *F21K 9/232* (2016.08); *F21V 3/02* (2013.01);
(Continued)

(58) Field of Classification Search
CPC . F21K 9/23; F21K 9/232; F21K 9/237; F21V 29/86; F21V 19/003; F21V 19/006;
(Continued)

(56) References Cited

U.S. PATENT DOCUMENTS

| | | | |
|---|---|---|---|
| 1,753,273 | A | 4/1930 | Laib |
| 5,083,251 | A | 1/1992 | Parker |

(Continued)

FOREIGN PATENT DOCUMENTS

| | | | |
|---|---|---|---|
| CN | 201344404 | | 11/2009 |
| DE | 196240871 | A1 | 12/1997 |

(Continued)

*Primary Examiner* — Alexander Garlen
(74) *Attorney, Agent, or Firm* — Akarsh P. Belagodu

(57) ABSTRACT

The present invention discloses an illumination device (100). The illumination device (100) comprises a light source (110) arranged to generate light, a carrier (120) arranged to support the light source and an envelope (130) enclosing the light source and the carrier. The envelope comprises at least two enveloping parts which, when joined together, form the envelope. Further, the carrier is arranged in thermal contact with at least one of the enveloping parts for dissipating heat out of the illumination device.

19 Claims, 4 Drawing Sheets

(51) Int. Cl.

| | |
|---|---|
| ***F21V 29/85*** | (2015.01) |
| ***F21V 3/02*** | (2006.01) |
| ***F21V 3/04*** | (2006.01) |
| ***F21K 9/23*** | (2016.01) |
| ***F21K 9/232*** | (2016.01) |
| *F21V 19/00* | (2006.01) |
| *F21Y 115/10* | (2016.01) |

(52) U.S. Cl.
CPC ..... *F21V 3/0409* (2013.01); *F21V 19/003* (2013.01); *F21V 19/006* (2013.01); *F21Y 2115/10* (2016.08); *Y10T 29/49002* (2015.01)

(58) Field of Classification Search
CPC ..... F21V 3/0409; F21V 3/02; F21Y 2101/00; Y10T 29/49002
See application file for complete search history.

(56) References Cited

U.S. PATENT DOCUMENTS

| | | | | |
|---|---|---|---|---|
| 5,165,784 | A | 11/1992 | Loth et al. | |
| 5,749,646 | A | 5/1998 | Brittell | |
| 6,626,554 | B2 | 9/2003 | Rincover et al. | |
| 7,049,746 | B2 * | 5/2006 | Mano | F21K 9/232 257/100 |
| 7,261,437 | B2 | 8/2007 | Coushaine et al. | |
| 7,461,951 | B2 | 12/2008 | Chou et al. | |
| 7,575,339 | B2 | 8/2009 | Hung | |
| D626,257 | S | 10/2010 | Pickard | |
| 7,976,182 | B2 | 7/2011 | Ribarich | |
| 8,220,956 | B2 | 7/2012 | Lai et al. | |
| 8,227,962 | B1 | 7/2012 | Su | |
| 8,317,358 | B2 | 11/2012 | Chou | |
| 8,547,002 | B2 | 10/2013 | Lenk et al. | |
| 8,894,238 | B2 | 11/2014 | Marinus et al. | |
| 2005/0189557 | A1 | 9/2005 | Mazzochette et al. | |
| 2006/0043546 | A1 | 3/2006 | Kraus | |
| 2006/0098440 | A1 | 5/2006 | Allen | |
| 2006/0227558 | A1 | 10/2006 | Osawa et al. | |
| 2006/0274529 | A1 | 12/2006 | Cao | |
| 2007/0230188 | A1 | 10/2007 | Lin | |
| 2008/0013316 | A1 | 1/2008 | Chiang | |
| 2008/0310158 | A1 | 12/2008 | Harbers et al. | |
| 2009/0080187 | A1 | 3/2009 | Chou | |
| 2009/0161359 | A1 | 6/2009 | Siemiet et al. | |
| 2010/0008086 | A1 | 1/2010 | Broitzman | |
| 2010/0314985 | A1 | 12/2010 | Premysler | |
| 2011/0062847 | A1 * | 3/2011 | Chen | F21V 29/004 313/46 |
| 2011/0089838 | A1 | 4/2011 | Pickard et al. | |
| 2011/0133222 | A1 * | 6/2011 | Allen | F21K 9/233 257/88 |
| 2012/0069570 | A1 | 3/2012 | Marinus et al. | |
| 2012/0134158 | A1 | 5/2012 | Yang et al. | |

FOREIGN PATENT DOCUMENTS

| | | | |
|---|---|---|---|
| DE | 202007008258 | U1 | 12/2007 |
| DE | 202008016867 | U1 | 4/2009 |
| JP | 08293204 | A | 11/1996 |
| JP | 2001243809 | A | 9/2001 |
| JP | 2007234639 | A | 9/2007 |
| WO | 2008077627 | A1 | 7/2008 |
| WO | 2008078235 | A2 | 7/2008 |
| WO | 2008154172 | A1 | 12/2008 |
| WO | 2009021695 | A1 | 2/2009 |
| WO | 2009150574 | A1 | 12/2009 |

* cited by examiner

ILLUMINATION DEVICE

CROSS-REFERENCE TO PRIOR APPLICATIONS

This application is a continuation of U.S. patent application Ser. No. 13/321,848, filed on Nov. 22, 2011, which is a U.S. National Phase application under 35 U.S.C. §371 of International Application No. PCT/IB2010/52282, filed on May 21, 2010, which claims the benefit of European Patent Application No. 10162146.4, filed on May 6, 2010, European Patent Application No. 09161346.3, filed on May 28, 2009, and European Patent Application No. 09166081.1, filed on Jul. 22, 2009. These applications are hereby incorporated by reference herein.

FIELD OF THE INVENTION

The present invention relates to an illumination device and to a method for assembly of an illumination device.

BACKGROUND OF THE INVENTION

Light-emitting-diode (LED) lamps are known in the art. A LED lamp is a lamp that uses LEDs as the source of light. In such lamps, multiple diodes may be used for either increasing the output power of the lamp or for providing a white light as a single LED emits in a narrow band of wavelengths. LED lamps may be used for general lighting or even more specific lighting as the colour and the output power may be tuned.

Generally, a lamp or illumination device comprises a light source arranged to generate light and mounted on, or at least connected to, a circuit board. The light source is arranged within an encapsulating housing usually having the shape of a bulb. In addition to provide maximum light output and/or a specific colour of light, the design of an illumination device needs to take into account the evacuation of heat generated by the light source(s) and/or the electronics connected to the light source(s).

For example, American patent application US2010/0008086 discloses a white LED-based lighting device comprising a group of solid state light emitting diodes, electronics to activate the light emitting diodes and an encapsulating housing. For conducting or transferring outwardly heat generated from within the white light LED device, the encapsulating housing includes air vents and heat-sinking components.

SUMMARY OF THE INVENTION

Generally, a disadvantage of prior art systems may be that such systems require a high number of components including specific details for evacuation of heat (e.g. an encapsulating housing, light source(s), a circuit board, air-vents and heat sinking components), thereby rendering the assembly of the system rather complex.

Hence, it is an object of the present invention to alleviate the above mentioned drawback, and to provide an illumination device having a convenient design for facilitating its assembly.

This and other objects of the present invention are achieved by means of an illumination device and a method for assembly of an illumination device as defined by the independent claims. Other advantageous embodiments of the present invention are defined by the dependent claims.

According to a first aspect of the invention, an illumination device as defined in claim 1 is provided. The illumination device comprises a light source arranged to generate light, a carrier arranged to support the light source and an envelope enclosing the light source and the carrier. The light source is in thermal contact with the carrier and the envelope comprises at least two enveloping parts which, when joined together, form the envelope. The carrier is arranged in thermal contact with at least one of the enveloping parts for dissipating heat out of the illumination device.

According to a second aspect of the present invention, a method for assembly of an illumination device comprising a light source arranged to generate light as defined in claim 11 is provided. The method comprises the steps of mounting the light source in thermal contact with a carrier and enclosing the light source by joining at least two enveloping parts, thereby forming an envelope enclosing the light source. The carrier is arranged in thermal contact with at least one of the enveloping parts for dissipating heat out of the illumination device.

The present invention makes use of an understanding that the envelope or bulb of an illumination device may comprise at least two enveloping parts which, when joined together, form the envelope (or encapsulating housing of the illumination device). The present invention is advantageous in that it provides a convenient design which facilitates the assembly of an illumination device (such as a lamp or spot light). Using two enveloping parts, the light source and the carrier may conveniently be mounted together while the two enveloping parts are separated and then enclosed in the envelope by joining the two enveloping parts. It will be appreciated that more than two enveloping parts may be employed and that the present invention is not limited to an illumination device comprising an envelope made of only two enveloping parts.

The present invention makes also use of an understanding that the envelope (or bulb) of the illumination device may act as a heat sink and serve for dissipating heat (e.g. generated by the light source or any electronics connected to the light source) out of the illumination device. For this purpose, the light source is arranged in thermal contact with a carrier which itself is in thermal contact with at least one of the enveloping parts of the envelope. With the present invention, the whole surface of the illumination device, i.e. the envelope, acts as a heat sink. Thus, the present invention is advantageous in that an effective transfer of heat to the outside environment of the illumination device is provided.

According to an embodiment, the carrier and the envelope may be made of ceramic material, which is advantageous in that it is a kind of material having good thermal conductivity, thereby allowing a relative efficient transfer of heat. For example, the ceramic material may be poly crystalline aluminium oxide (PCA), which is advantageous in that it is a translucent ceramic material.

According to an embodiment, the envelope may have the shape of a bulb (or lamp bulb). In particular, the enveloping parts may be two bulb halves.

According to an embodiment, an enveloping part and at least part of the carrier (or a first part of the carrier or first carrier) may form a single integrated part, which is advantageous in that the number of components is reduced, thereby facilitating even further the assembly of the illumination device. The present embodiment is also advantageous in that the enveloping part and the part of the carrier (e.g. a bulb half and half of the carrier) may be manufactured as one single part from one single mould. The corresponding enveloping part(s) and part of the carrier for forming the envelope and the carrier may also be manufactured from one single mould, preferably the same mould.

According to another embodiment, the carrier may be arranged at a junction between two enveloping parts. In the present embodiment, the carrier and the enveloping parts are separate parts.

According to an embodiment, the enveloping parts may advantageously be configured to fit one to another, thereby facilitating the assembly of the illumination device.

According to an embodiment, the carrier may be arranged along an axis extending from the base of the illumination device to its top. Alternatively, the carrier may be arranged along a direction crossing an axis extending from the base of the illumination device to its top. In these embodiments, the carrier divides the space defined by the envelope in at least two compartments. A plurality of light sources may then advantageously be used and distributed on each side of the carrier such that an uniform illumination is provided.

According to an embodiment, the envelope may comprise a transmissive region arranged to transmit at least part of the light generated by the light source (especially when the light source emits in the visible range of the wavelength spectrum, i.e. 380-780 nm). The transmissive region may be translucent (transmitting and scattering of light) or be transparent (substantial unhindered transmission). Advantageously, the transmissive region is translucent, thereby preventing a user from perceiving the light source(s) and optional electronics within the envelope. As mentioned above, the envelope may be made of PCA, thereby providing a translucent envelope. Thus, the envelope or encapsulating housing of the illumination device is advantageous in that it integrates a number of functionalities such as an optical function, a thermal function and a mechanical function.

According to an embodiment, the carrier may comprise a reflective region arranged to reflect at least part of the light generated by the light source(s). Alternatively or in addition, the carrier may comprise a transmissive region arranged to transmit at least part of the light generated by the light source.

According to an embodiment, the light source may be at least one light emitting diode (LED) or at least one LED package. The light source may for instance comprise an RGB LED (red green blue light emitting diode), or a plurality of diodes arranged to provide white light, such as an RGB combination, or a combination of blue and yellow, or a combination of blue, yellow and red, etc. Optionally, the illumination device may be arranged to provide coloured light.

The light source may also comprise a plurality of light sources (such as a plurality of LEDs), that is (are) able to provide light at different predetermined wavelengths, depending upon the driving conditions. Hence, in a specific embodiment, the illumination device may further comprise a controller (attached to or external from the illumination device), arranged to control the colour of the illumination device light in response to a sensor signal or a user input device signal.

In the following, the invention may be further described with reference to a LED as preferred embodiment of the light source. Hence, in the following the term "LED" may also refer to a light source (or a plurality of light sources) in general, unless indicated otherwise or clear from the context, but preferably refers to a LED. Further, the term "LED" especially refers to solid state lighting (solid state LEDs).

According to an embodiment, the light source may emit light in the visible range, but may also, in another embodiment, alternatively or additionally emit in the UV range. As mentioned above, the light source may comprise a LED. In a further embodiment, the light source is a LED arranged to generate blue light. The blue light emitting source may be used per se, or may be used in combination with luminescent material, e.g. arranged at the envelope or at least one of the enveloping parts, such as to provide white light, or may be used in combination with one or more other LEDs generating light at other wavelengths. Combinations of such embodiments may also be applied.

According to an embodiment, the carrier or part of the carrier may be glued to an enveloping part of the envelope. Advantageously, the glue has good thermal properties such that heat can be dissipated from the carrier to the enveloping part.

Alternatively, the carrier may be inserted at a junction between two enveloping parts. In the present example, the carrier is advantageously pressed between two enveloping parts such that a good thermal contact is provided between the carrier and the enveloping parts for heat dissipation.

According to an embodiment, a base of the envelope (or illumination device) is inserted in a socket acting as an holder. The socket may also be configured to provide electricity to the light source.

In the present application, the term "at least" may in embodiments also indicate "all" or "completely".

It is noted that the invention relates to all possible combinations of features recited in the claims.

BRIEF DESCRIPTION OF THE DRAWINGS

This and other aspects of the present invention will now be described in more detail, with reference to the appended drawings showing various exemplifying embodiments of the invention.

DETAILED DESCRIPTION

Figure 1:
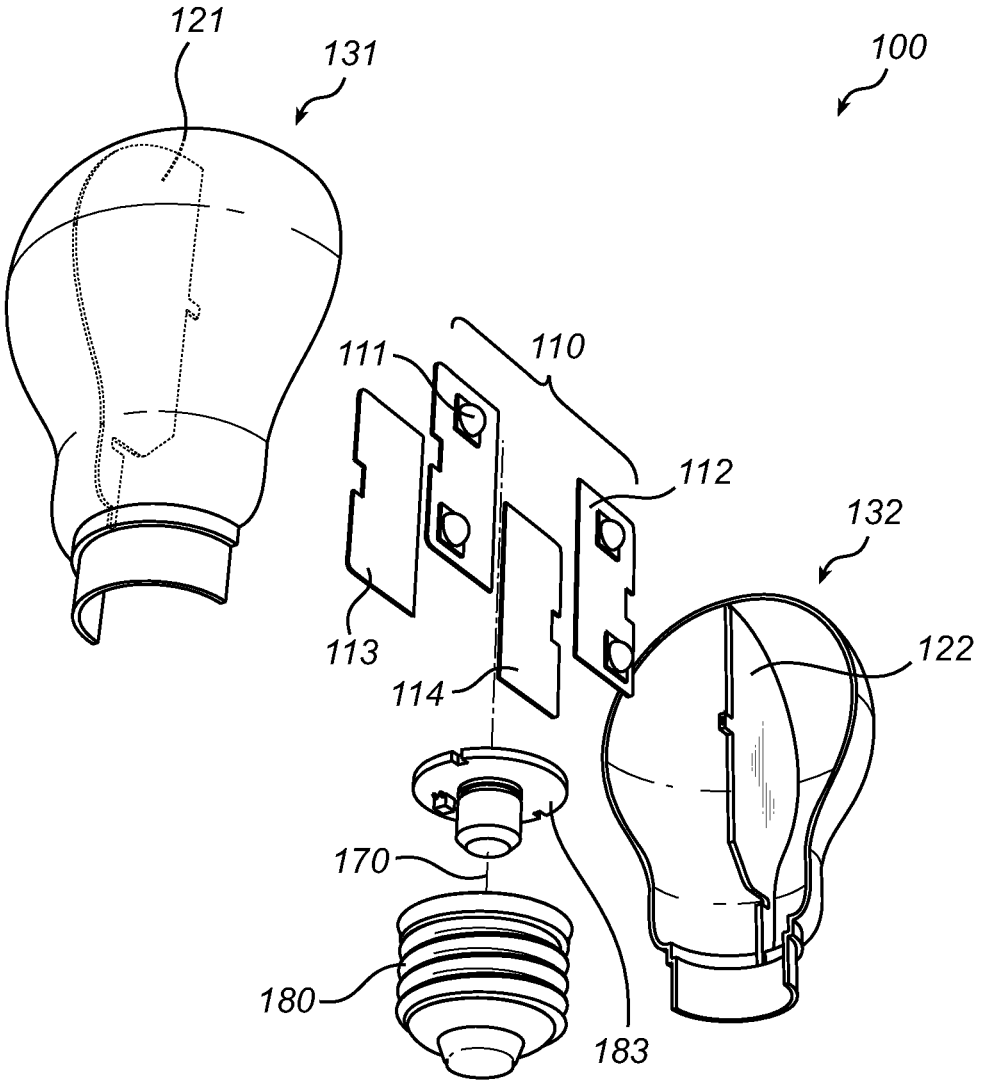
FIG. 1 is an exploded view of an illumination device according to an exemplifying embodiment of the present invention.

With reference to FIG. 1, a first embodiment of the present invention is described.

FIG. 1 shows an exploded view of an illumination device 100 according to an embodiment of the present invention. The illumination device comprises a light source 110 arranged to generate light. In the present example, the light source 110 corresponds to a plurality of LED packages 111, 112, 113 and 114. Although FIG. 1 shows a plurality of LED packages to form the light source 110, a single light source may also be used.

The illumination device 100 further comprises two carrier parts 121 and 122 (or a first carrier 121 and a second carrier 122) arranged to support the light source 110 or LED packages 111-114. In the following, the two carrier parts 121 and 122 may also be referred to as a single carrier, when the two parts are intended to be joined together, and will generally be referred to as a carrier 120.

The illumination device 100 comprises also two enveloping parts 131 and 132 which, when joined together, form an envelope or encapsulating housing generally denoted as a single envelope 130 in the following. The envelope 130 encloses the light sources 111-114 and the carriers 121 and 122. The light sources 111-114 (or light source 110) are arranged in thermal contact with the carriers 121 and 122. The carrier 120 is arranged in thermal contact with the enveloping parts 131 and 132, respectively.

Using such a design, when the illumination device is powered on, heat may be generated by the light source(s) 111-114 and be dissipated out of the illumination device 100 via the carriers 121 and 122 and the enveloping parts 131 and 132.

In the present embodiment, the first and second carriers 121 and 122 divide the illumination device 100 in two compartments. Advantageously, the light source(s) 111-114 of the illumination device may be distributed on each side of the first and second carriers 121 and 122 for improving the uniformity of the light emitted from the illumination device 100.

The envelope 130 may especially be arranged to receive all light from the light source(s) 111-114. Further, the envelope 130 may especially be arranged to allow escape of light of the light source(s) 111-114.

When a plurality of light sources are used and the light sources emit light at different wavelengths, the envelope 130 may thus also be indicated as a mixing chamber. Mixing may also be of relevance when a luminescent material is used that is arranged remote from a light source (from which it absorbs part of the light to provide luminescent material light), e.g. arranged at the envelope or part of the envelope.

Advantageously, the envelope 130 may comprise a transmissive region arranged to transmit at least part of the light generated by the light sources 111-114.

According to an embodiment, the carrier 120 may also comprise a transmissive region, which is advantageous in that light coming from a compartment of the envelope in direction to the carrier may be transmitted through the carrier and, then, transmitted out of the illumination device via the envelope 130. In particular, the envelope 130 may be made of a material having light transmissive properties such that an efficient transmission of light through the envelope is achieved.

Alternatively, or in addition, the carrier 120 may comprise a reflective region arranged to reflect at least part of the light generated by the light source(s), which is advantageous in that light emitted in a compartment of the envelope and directed towards the carrier may be reflected against the carrier and transmitted out of the illumination device via the same compartment of the envelope. It will be appreciated that the carrier may be designed with a number of various regions being either transmissive or reflective such that, e.g., a desired light distribution is achieved.

In the embodiment shown in FIG. 1, the envelope 130 is bulb-shaped and the enveloping parts 131 and 132 are two bulb halves, thereby providing an illumination device which has a standard lamp shape.

According to an embodiment, both the envelope and the carrier comprises ceramic material, which is advantageous in that it improves the transfer of heat from the illumination device.

The term "ceramic" is known in the art and may especially refer to an inorganic, non-metallic solid prepared by the action of heat and subsequent cooling. Ceramic materials may have a crystalline or partly crystalline structure, or may be amorphous, i.e., a glass. Most common ceramics are crystalline. The term ceramic especially relates to materials that have sintered together and form pieces (in contrast to powders). The ceramics used herein are preferably polycrystalline ceramics.

The ceramic material may for instance be based on one or more materials selected from the group consisting of $Al_2O_3$, AlN, $SiO_2$, $Y_3Al_5O_{12}$ (YAG), an $Y_3Al_5O_{12}$ analogue, $Y_2O_3$ and $TiO_2$, and $ZrO_2$. The term an $Y_3Al_5O_{12}$ analogue refers to garnet systems having substantially the same lattice structure as YAG, but wherein Y and/or Al and/or O, especially Y and/or Al are at least partly replaced by another ion, such as one or more of Sc, La, Lu and G, respectively.

According to an embodiment, the ceramic material may be $Al_2O_3$, which is a translucent material. $Al_2O_3$ can also be made highly reflective when it is sintered at a temperature in the range of about 1300-1700° C., such as in the range of about 1300-1500° C., like 1300-1450° C. This material is also known in the art as "brown" PCA (polycrystalline alumina).

The term "based on" indicates that the starting materials to make the ceramic material substantially consist of one or more of the herein indicated materials, such as for instance $Al_2O_3$ or $Y_3Al_5O_{12}$ (YAG). This does however not exclude the presence of small amounts of (remaining) binder material, or dopants, such as Ti for $Al_2O_3$, or in an embodiment Ce for YAG.

The ceramic material may have a relatively good thermal conductivity. Preferably, the thermal conductivity is at least about 5 W/mK, such as at least about 15 W/mK, even more preferably at least about 100 W/mK. YAG has a thermal conductivity in the range of about 6 W/mK, poly crystalline alumina (PCA) in the range of about 20 W/mK, and AlN (aluminum nitride) in the range of about 150 W/mK or larger.

Referring again to FIG. 1, the illumination device 100 may also comprise a socket 180 for holding the enveloping parts 131 and 132 and for providing, via a connecting board 183, electricity to the LED packages 111-114.

Figure 4A:
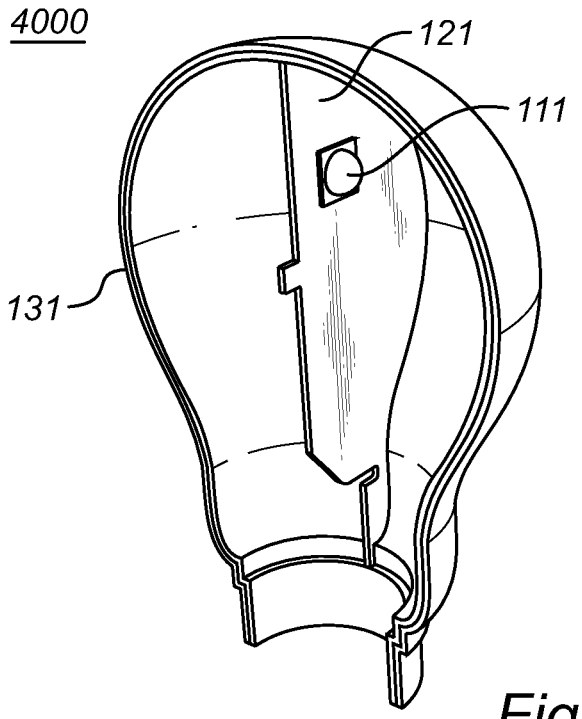
FIG. 4*a*-4*c* illustrate, in a schematic manner, a process flow of the method for assembly of an illumination device according to an exemplifying embodiment of the present invention.

According to an embodiment, referring to e.g. FIG. 1 and FIG. 4*a*, an enveloping part 131 and a part 121 of the carrier form a single integrated part. Such an embodiment is advantageous in that it further reduces the number of components for assembling the illumination device, thereby facilitating even more its assembly.

Figure 2:
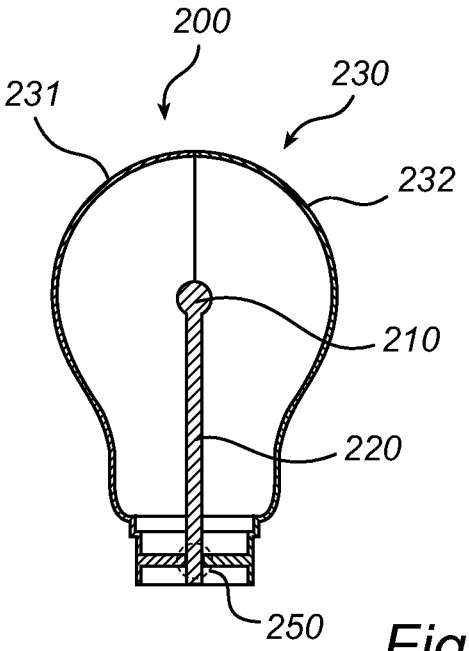
FIG. 2 is a schematic view of an illumination device according to another exemplifying embodiment of the present invention.

Referring to FIG. 2, another embodiment of the present invention is described.

FIG. 2 is a schematic view of an illumination device 200 comprising a light source 210, which may be a LED, arranged to generate light, a carrier 220 arranged to support the light source 210 and two enveloping parts 231 and 232 which, when joined together, form an envelope or encapsulating housing 230. The carrier 220 is arranged in thermal contact with the light source 210 and the carrier 220 is arranged at a junction 250 between the two enveloping parts 231 and 232. The junction 250 provides for a mechanical interface and a thermal interface between the carrier 220 and the enveloping parts 231 and 232. As for the embodiment described with reference to FIG. 1, heat generated by the light source 210 is dissipated outside the illumination device 200 by heat transfer via the carrier 220 and through the envelope 200.

With reference to any embodiments described above with reference to FIGS. 1 and 2, the enveloping parts of the envelope 130 or 230 of the illumination devices 100 and 200, respectively, are configured to fit one to another.

Figure 3:
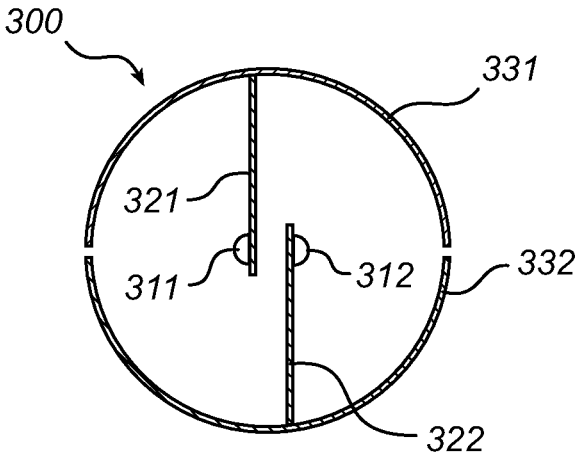
FIG. 3 is a schematic view of an illumination device according to another exemplifying embodiment of the present invention.

With reference to FIG. 3, another embodiment of the present invention is described.

FIG. 3 is a schematic top view of an illumination device 300 comprising two light sources 311 and 312, e.g. two LEDs, arranged to generate light. The two LEDs 311 and 312 are mounted on two carriers 321 and 322 (or two parts of a carrier) arranged to support the LEDs 311 and 312, respectively. In the present embodiment, a single LED package is mounted on, or attached to, a carrier. Alternatively, a plurality of LED packages may be mounted on a first carrier.

As illustrated in FIG. 3, the first carrier 321 attached to a first enveloping part 331 of the envelope may extend in the volume defined by the second enveloping part 332 of the envelope when the two enveloping parts are joined together. Similarly, the second carrier 322 attached to the second enveloping part 332 of the envelope may extend in the volume defined by the first enveloping part 331 of the envelope when the two enveloping parts are joined together. In other words, the first carrier 321 and the second carrier 322 may not be exactly arranged in front of each other but, instead, slightly displaced.

In the present embodiment, as for the embodiments described with reference to FIGS. 1 and 2, the carriers 321 and 322 are arranged along an axis 170 (see FIG. 1) extending from the base of the illumination device to its top.

Alternatively, the carrier may be arranged along a direction crossing the axis 170 extending from the base of the illumination device to its top.

In either case, the carriers define compartments within the envelope of the illumination device.

Figure 4B:
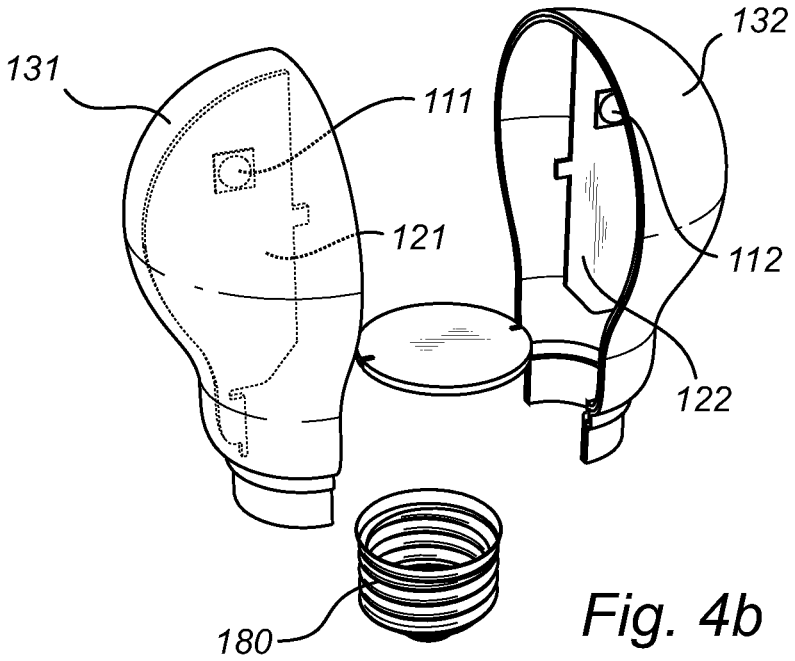
Figure 4C:
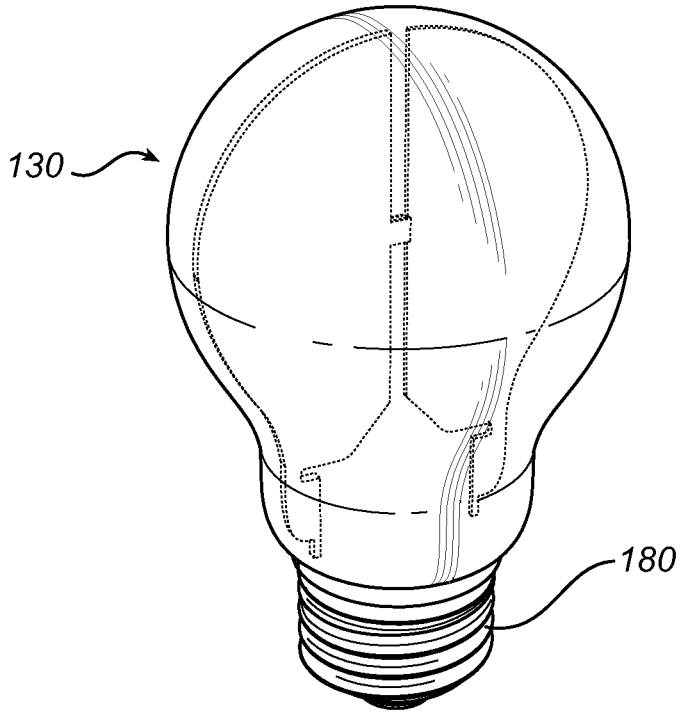

With reference to FIGS. 4*a*-4*c*, a process flow 4000 describing a method for assembly of an illumination device is described.

FIGS. 4*a*-4*c* schematically illustrate the assembly of an illumination device comprising a first bulb half 131 with a first carrier 121 on which a first light source 111 is mounted and a second bulb half 132 with a second carrier 122 on which a second light source 112 is mounted.

FIG. 4*a* shows the first enveloping part or bulb half 131 comprising the first carrier 121. The first bulb half 131 and the first carrier 121 may be a single integrated part, e.g. made out of a single mould. Alternatively, the first carrier 121 and the first bulb half are two separate parts and the first carrier 121 may be glued to the inside of the first bulb half 131. Advantageously, the glue has good thermal conductive properties such that heat can effectively be transferred from the first carrier 121 to the first bulb half 131.

In a first step 4100, a light source 111 is mounted in thermal contact with the first carrier 131. The light source 111 may for instance be attached to the carrier by means of a clip.

A similar step may then be applied with the second carrier 132 to which a second light source 112 is mounted in thermal contact.

In a second step 4200, the first light source 111, the first carrier 121, the second light source 112 and the second carrier 122 are enclosed by joining the two enveloping parts 131 and 132, such as illustrated in FIG. 4*b*.

As a result, an envelope 130 such as shown in FIG. 4*c* is formed. The envelope 130 may then be inserted in a socket 180 for holding the two enveloping parts 131 and 132. The socket 180 may also be configured to provide electricity to the illumination device such that electrical power can be transmitted to the light sources 111 and 112.

In this respect, the light source may advantageously be high-voltage (HV) LEDs, which is advantageous in that the number of components necessary to form the illumination device is further reduced as HV LEDs do not require any driver.

Even more advantageously, phase-shifted HV LEDs may be used and distributed on the carrier 130 (or the carriers 131 and 132) for preventing any stroboscopic effect.

The present invention may be useful for any kind of lamps such as a spot light or a standard lamp. The present invention may be applied for illumination devices used in homes, hospitality, outdoor, offices, industry and retail.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

For example, although the embodiments described above relate to an illumination device having a standard bulb shape, any other suitable shape may be envisaged. Further, although the embodiments described above comprise a first and a second carrier, it will be appreciated that the illumination device may comprise only one carrier in thermal contact with at least one of the enveloping parts. Further, the illumination device may also comprise more than two carriers or carrier parts.

Further, although the present invention has been described with reference to two enveloping parts for forming the envelope or encapsulating housing (or bulb), the present invention is not limited to such an embodiment and more than two enveloping parts may be used to form the envelope of the illumination device.

It will also be appreciated that the number of LEDs or light sources and their respective wavelengths will be selected in accordance with the desired application.

The invention claimed is:

1. An illumination device comprising:

a light source arranged to generate light, a carrier, comprising at least one carrier part, arranged to support said light source, said light source being in thermal contact with said carrier, an envelope enclosing said light source and said carrier, wherein the carrier is arranged in physical contact with the envelope for dissipating heat out of said illumination device, wherein the envelope includes at least two enveloping parts which, when joined together, form said envelope, and wherein a curved outer contour defined by the at least one carrier part matches at least a majority of a curved inner contour defined by an inner surface of at least one of the at least two enveloping parts in a direction parallel to a longitudinal axis of the illumination device from a position adjacent a portion of the at least one of the at least two enveloping parts that is insertable into a socket to an opposite side of the illumination device.

2. The illumination device according to claim 1, wherein said envelope comprises a first transmissive region arranged to transmit at least part of the light generated by the light source.

3. The illumination device according to claim 2, wherein said carrier comprises a second transmissive region arranged to transmit at least part of the light generated by the light source or a reflective region arranged to reflect at least part of the light generated by the light source.

4. The illumination device according to claim 1, wherein said envelope and said carrier comprise a ceramic material.

5. The illumination device according to claim 4, wherein the ceramic material of said envelope and said carrier is polycrystalline aluminum oxide, or the ceramic material of said envelope and said carrier has a thermal conductivity of at least about 5 W/mK.

6. The illumination device according to claim 1, wherein the envelope is bulb-shaped.

7. The illumination device according to claim 1, wherein the enveloping parts are two bulb halves.

8. The illumination device according to claim 1, wherein the carrier is arranged at a junction between the two enveloping parts.

9. The illumination device according to claim 1, wherein the enveloping parts are complementary and configured to fit one to another.

10. The illumination device according to claim 1, wherein the light source comprises at least one light emitting diode (LED) or at least one LED package.

11. The illumination device according to claim 4, wherein the ceramic material of said envelope or said carrier is translucent.

12. An illumination device comprising:

a light source arranged to generate light, a carrier, comprising at least one carrier part, arranged to support said light source, said light source being in thermal contact with said carrier, an envelope enclosing said light source and said carrier, wherein the carrier is arranged in thermal contact with the envelope for dissipating heat out of said illumination device, wherein the envelope includes at least two enveloping parts which, when joined together, form said envelope, wherein the carrier is arranged at a junction between the two enveloping parts, and wherein a curved outer contour defined by the at least one carrier part matches, at a widest portion of the envelope, a curved inner contour defined by an inner surface of at least one of the at least two enveloping parts in a direction parallel to a longitudinal axis of the illumination device from a position adjacent a portion of the at least one of the at least two enveloping parts that is insertable into a socket to an opposite side of the illumination device.

13. The illumination device of claim 12, wherein said envelope comprises a first transmissive region arranged to transmit at least part of the light generated by the light source.

14. The illumination device of claim 13, wherein said carrier comprises a second transmissive region arranged to transmit at least part of the light generated by the light source or a reflective region arranged to reflect at least part of the light generated by the light source.

15. The illumination device of claim 12, wherein said envelope and said carrier comprise a ceramic material.

16. An illumination device, comprising:

a light source operable to emit light;

a carrier in support of the light source, the light source being in thermal contact with said carrier;

a multi-part envelope enclosing said light source and said carrier, wherein the carrier is arranged in physical contact with the envelope for dissipating heat out of said illumination device through the envelope;

wherein the multi-part envelope includes at least two enveloping parts which are joined together to form the envelope, a curved outer contour defined by the carrier matches a curved inner contour defined by an inner surface of at least one of the at least two enveloping parts along a substantial portion of the multi-part envelope in a direction parallel to a longitudinal axis of the illumination device from a position adjacent a portion of the at least one of the at least two enveloping parts that is insertable into a socket to an opposite side of the multi-part envelope; and the multi-part envelope including at least one enveloping part and at least part of the carrier to form a single integrated part.

17. The illumination device of claim 16, wherein said multi-part envelope and said carrier comprise a ceramic material.

18. The illumination device of claim 17, wherein the ceramic material of said multi-part envelope and said carrier is polycrystalline aluminum oxide, or the ceramic material of said multi-part envelope and said carrier has a thermal conductivity of at least about 5 W/mK.

19. The illumination device according to claim 16, wherein the multi-part envelope is bulb-shaped.

* * * * *